United States Patent [19]

Kühn

[11] Patent Number: 4,596,610

[45] Date of Patent: Jun. 24, 1986

[54] HARDENING METAL PARTS

[75] Inventor: Friedhelm Kühn, Mühlheim/Ruhr, Fed. Rep. of Germany

[73] Assignee: Ruhrgas Aktiengesellschaft, Essen, Fed. Rep. of Germany

[21] Appl. No.: 573,537

[22] Filed: Jan. 25, 1984

[30] Foreign Application Priority Data

Jan. 25, 1983 [DE] Fed. Rep. of Germany ..... 3302338

[51] Int. Cl.[4] ..... C21D 1/74

[52] U.S. Cl. ..... 148/16.5; 148/16.6; 148/20.3; 148/128

[58] Field of Search ..... 148/13.1, 20.3, 16, 148/16.5, 16.6, 14, 128; 266/252, 254, 255, 262

[56] References Cited

U.S. PATENT DOCUMENTS

| | | | |
|---|---|---|---|
| 2,101,481 | 12/1937 | Stein | 266/262 |
| 2,385,407 | 9/1945 | Endress | 266/262 |
| 2,689,807 | 9/1954 | Kemp et al. | 266/252 |

*Primary Examiner*—Christopher W. Brody
*Attorney, Agent, or Firm*—Jordan and Hamburg

[57] ABSTRACT

To harden individual metal parts in a continuous low-energy heat treatment process consisting of clearly separate stages, the part to be heated is placed in a sealed heat treatment box consisting of two layers of porous material separated by a gas-tight barrier. A heat-releasing atmosphere is caused to enter into the material of the two layers during the heating stage, the atmosphere moving from the inner layer of porous material into the box chamber thereby heating the metal part being treated to a diffusion temperature above hardening temperature. An atmosphere releasing components for diffusion is caused to enter the box chamber through the inner layer of porous material during the diffusion stage, with the heat releasing atmosphere continuing to enter the outer layer of porous material. The entry of hot atmosphere into the outer layer of porous material is stopped during the cooling stage, and a cooling atmosphere is caused to enter the box chamber through the inner layer of porous material, to reduce the temperature of the part being heat-treated to the hardening temperature. The temperature having been thus reduced, the part is quenched during the quenching stage by means of a quenching agent preferably following the transfer of the part to a cooling box the hardening agent entering the cooling box through porous material lining the box. A rotating arrangement may be used to transport several heat treatment and cooling boxes through the different treatment stages.

21 Claims, 2 Drawing Figures

HARDENING METAL PARTS

BACKGROUND OF THE INVENTION

1. Field of the Invention

The present invention relates to a method of and apparatus for hardening metal parts by means of a heat treatment process, the process consisting of a heating stage for preheating of the parts to be treated to a temperature in excess of the hardening temperature, a diffusion stage to treat the parts by the diffusion of components from the atmosphere into the parts, a cooling stage to reduce the temperature of the parts to the hardening temperature and a quenching stage to quench said parts.

2. Description of the Prior Art

The above-described hardening techniques are used to heat metal parts to be hardened to their cores, or to heat the surface layers of such metal parts if such parts are large, to a diffusion temperature in excess of the hardening such as a temperature, of 920° C. or any other diffusion temperature and to treat the parts at the diffusion temperature which is maintained for a certain period of time, by carburizing of carbonitriding in a gaseous atmosphere, from which components diffuse into the surface of the parts being treated, whereupon the temperature of the parts is reduced to the hardening temperature, with some diffusion possibly still occurring during the temperature reduction, and then the parts are quenched in a quenching medium. To increase the output of such hardening facilities by means of continuous operation, it is a well-known technique to employ pusher-type plants where the parts so treated are usually combined to form charges consisting of a large number of individual parts which pass through the heating, diffusion and cooling stages of a continuous chamber. If the continuous pusher-type technique described is used, the different chamber zones representing the different treatment stages interact, the temperature and atmosphere transitions between the different zones being gradual. The known technique described does not provide abrupt changes in temperature or atmosphere which would increase the rates of heat or mass transfer. If these rates were increased, energy consumption could be reduced considerably and the metallurgical treatment of parts could be controlled more effectively. If a conventional furnace employing the technique described were to be designed for such abrupt changes in temperature or atmosphere, such continuous furnace chamber would have to be broken up into separate chambers, one such separate chamber being provided for each zone. The locks or vestibules and the gas-tight doors which would be required for separation between such chambers would, however, be very complex and costly in view of the high temperatures at which metal parts are so treated. Further, as in the case of known heat treatment plant designs for batch-type operation, the parts treated in the continuous chamber of conventional continuous installations are usually densely packed, with heat and gaseous atmosphere for treatment having to move to the surface of each part so treated. It is a known drawback of such continuous heat treatment installations that the time required for heating each part and the time required for the process of diffusion is considerably longer than in a case where each part is treated separately, and that the rate of heat transfer to each such part constituting the charge may be different, causing the warping of parts and thus necessitating costly straightening and other post-treatment operations.

SUMMARY OF THE INVENTION

1. Purposes of the Invention

It is an objective of this invention to provide a method of and apparatus for treatment of separate individual parts in the manner described hereinabove so that heating of each part so treated will be more rapid and more uniform, mass transfer to each such part by diffusion will be faster, and cooling of the parts so treated will be quicker and more uniform than in the case of known conventional processes for continuous heat treatment, the method of heat treating such individual and separate parts being suitable and appropriate for continuous high output operation, and, reducing energy consumption for such treatment.

2. Brief Description of the Invention

To harden individual metal parts in a continuous low-energy heat treatment process consisting of clearly separate stages, the part to be heated is placed in a sealed heat treatment box consisting of two layers of porous material separated by a gas-tight barrier. A heat-releasing atmosphere is caused to enter into the material of the two layers during the heating stage, the atmosphere moving from the inner layer of porous material into the box chamber thereby heating the metal part being treated to a diffusion temperature above hardening temperature. An atmosphere releasing components for diffusion is caused to enter the box chamber through the inner layer of porous material during the diffusion stage, with the heat releasing atmosphere continuing to enter the outer layer of porous material. The entry of hot atmosphere into the outer layer of porous material is stopped during the cooling stage, and a cooling atmosphere is caused to enter the box chamber through the inner layer of porous material, to reduce the temperature of the part being heat-treated to the hardening temperature. The temperature having been thus reduced, the part is quenched during the quenching stage by means of a quenching agent, preferably following the transfer of the part to a cooling box, with the hardening agent entering the cooling box through porous material lining the box. A rotating arrangement may be used to transport several heat treatment and cooling boxes through the different treatment stages.

The invention accordingly consists in the method and apparatus for hardening metal parts as described supra and as shown in the drawings, and as will be further elucidated infra and claimed in the appended claims.

BRIEF DESCRIPTION OF THE DRAWINGS

In the accompanying drawings in which is illustrated one embodiment of the invention.

DETAILED DESCRIPTION OF THE PREFERRED EMBODIMENTS

Figure 1:
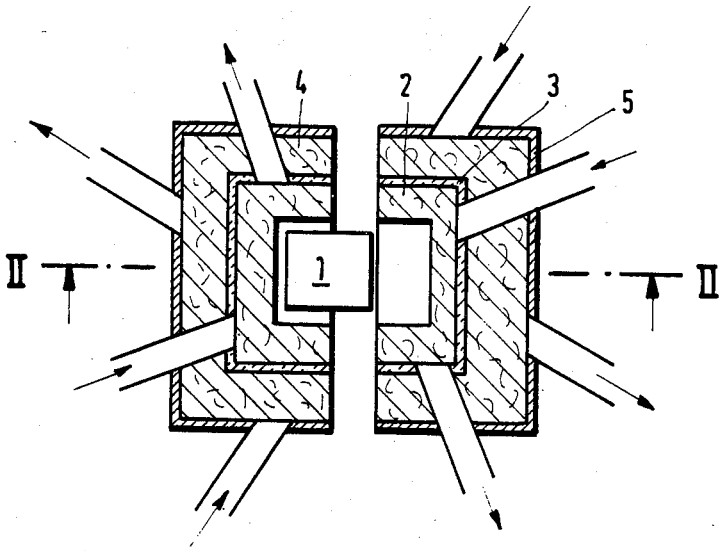
FIG. 1 is a horizontal sectional view of a heat treatment box, partly open, according to the one embodiment.
Figure 2:
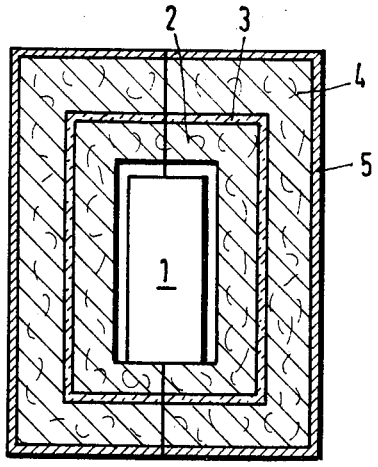
FIG. 2 is a vertical sectional view of the heat treatment box of FIG. 1 in a closed condition.

Referring now to the drawings:

The numeral 1 indicates the workpiece, No. 2 indicates the inner porous layer, No. 3 indicates the gas-tight barrier, No. 4 indicates the outer porous layer, and No. 5 indicates the gas-tight housing.

EXAMPLES OF MATERIALS UTILIZED IN THE INVENTION

Material for the porous interior layer: zirconium dioxide

Material for the porous exterior layer: zirconium dioxide

Material for the gastight intermediate layer: silicon carbide with infiltrated silicon Heat emitting atmosphere: Under-stoichiometric mixture of air and natural gas Diffusion atmosphere:

- Carburizing: Carbon, carbon-monoxide, carbon-dioxide, hydrogen, water and nitrogen
- Nitrifying: The above components in a different composition and additionally with ammonia Cooling atmosphere:

- Nitrogen
- Fluids, for example, oil

Quench components:

- Oil
- Nitrogen (supercooled, previously liquefied)

Material of the metal parts or workpieces:

- Steel, preferably drive parts.

According to one aspect of this invention, a metal part to be heat treated is placed in a heat treatment box designed for gas-tight sealing and lined by an inner layer of continuous porous material opening to the box chamber the inner layer of porous material being surrounded by an outer layer of continuous porous material separated from the inner layer by a gas-tight barrier which permit the passage of heat, a heat releasing atmosphere is caused to enter both the inner layer and the outer layer of continuous porous material and the heat releasing atmosphere entering the inner layer of continuous porous material passes into the heat treatment box and is circulated through the heat treatment box chamber during the heating stage, an atmosphere releasing components for diffusion is caused to enter the inner layer of porous material and is circulated through the heat treatment box chamber by means of the inner layer during the diffusion stage, the diffusion temperature in the heat treatment box chamber being maintained by the passage of heat releasing atmosphere through the outer layer of porous material, heat input into the outer layer of material during the cooling stage is interrupted, a cooling atmosphere being caused to enter the inner layer of porous material and to circulate through the heat treatment box chamber by means of the inner layer of porous material, and the part so treated is finally quenched during the quenching stage after the temperature of the part has decreased to the hardening temperature.

Using the method and apparatus which is the subject of the present invention, employing one such heat treatment box for one part to be heat treated, the porous material, which may be a ceramic material, and the part so heat treated, may be heated very rapidly. The heat releasing atmosphere passing through the inner layer of porous material into the heat treatment box chamber may be circulated under pressure, so that the part being treated is exposed to the impingement of jets of hot atmosphere leaving the pores of the inner layer of porous material the impingement producing a heat transfer rate many times higher than in case of the continuous treatment in a conventional installation. The method which is the subject of the present invention thus also allows continuous high output operations, in spite of the separate treatment of individual parts, by using an arrangement such as a rotating arrangement holding a number of boxes which are transported to stations for heating, diffusion, and cooling, where the two layers of porous material of each heat treatment box arriving at each such station are connected to systems providing the heat releasing atmosphere, the atmosphere releasing components for diffusion, and the cooling atmopshere as required.

When the temperature in the two layers of porous material of any such heat treatment box has increased to a preset temperature, such as a temperature of 700° C., it will then only be necessary to cause heat releasing atmosphere to enter into the outer layer of porous material, to prevent across-the-wall heat loss and to supply the heat needed to heat the part being treated to a given diffusion temperature, such as the diffusion temperature of 920° C., by the conduction of heat to the inner layer of porous material, where heat exchange will occur with the atmosphere passing through the inner layer. The heat releasing atmosphere passing through the inner and the outer layers of porous material used for lining the heat treatment box during the heating stage is preferably a rich mixture of air and fuel, gas such as natural gas, combusting in the pores of the material of said two layers so that no flames will leave the two layers, or the inner layer of porous material. Following a sufficient increase in the temperature of the porous materials of the two layers referred to and preferably thereafter stoichiometric mixture of air and fuel gas is caused to enter the outer layer of porous material during the diffusion stage where it is combusted in the pores, the atmosphere passing through the inner layer of the porous material merely being circulated and being heated by the outer layer of porous material without any external heating, with heat losses from the heat treatment box thus being prevented.

When the temperature of the part being treated has risen to the desired diffusion temperature, the atmosphere circulating through the inner layer of porous material and the heat treatment box chamber may be replaced abruptly by the atmosphere releasing the components to diffuse into the part being treated, so that diffusion into the part will commence abruptly and will be rapid. Heating and diffusion may be controlled preferably, or as desired in the case of the treatment of large parts, so that the temperature, in the core of the part being treated will only increase to the hardening temperature and the temperature in the surface of the part being treated will increase to a desired case depth to the diffusion temperature at which it will be carburized or carbonitrided by the diffusion of components of the gaseous atmosphere.

Following the completion of diffusion, the flow of heat releasing atmosphere to the outer layer of porous material of the heat treatment box is stopped or interrupted during the cooling stage, until the temperature of the part being treated has decreased to the hardening temperature, with a cooled atmosphere possibly being circulated through the inner layer of porous material and the heat treatment box chamber for a short period, for a favourable abrupt transition between the diffusion stage and the cooling stage.

In another aspect, the present invention provides for advantageous quenching of the part being treated during the quenching stage by placing the part placed in a box with a porous box lining open to the box chamber, the quenching medium being circulated to the box chamber through the lining. To reduce energy consumption and to improve energy efficiency, the method which is the subject of this invention may preferably be modified so that the heat treatment box holding the part to be treated only passes through the high temperature heating, diffusion and cooling stages, the part being treated being transferred from the heat treatment box to a separate cooling box for the quenching stage preferably using a controlled atmosphere in an enclosure or lock for the transfer, when the part being treated has cooled to the hardening temperature. In one embodiment of the invention, the heat treatment box is transferred from a rotating arrangement transporting the box through the heating, diffusion and cooling stages to a lock in which the part being treated is removed from the heat treatment box and transferred to the separate cooling box the empty heat treatment box, being returned from the lock to the rotating arrangement for recharging and travelling again through the heating, diffusion and cooling stages. In the above embodiment, the cooling box may be lined by a porous cooling box lining material particularly appropriate and designed for quenching, the pores of which are largely arranged at right angles to the part being treated so as to preferably discharge a pressurized liquid quenching medium reaching the surface of the part being treated at right angles to the surface. It is another aspect of the present invention that the flow of the pressurized liquid quenching medium during the quenching stage may be controlled to optimize the squencing of the different phases of quenching (film evaporation, boiling, convection) for the quenching medium used. The quenching operation may be carried out using any device, such as a cooling machine, taking the cooling box holding the part to be treated from the lock through the different cooling phases.

The method and apparatus which is the subject of this invention may be employed, using an automatic system, for simultaneously heat treating different parts held by different boxes to different specifications, such as specifications for the heating and the diffusion stages, to optimize heat treatment for material flow conditions and surface treatment requirements. The present invention hence eliminates a drawback of known conventional continuous furnace plants consisting in that such conventional furnace plants can only be operated for one mode of heat treatment and cannot be used for the simultaneous heat treatment of different parts, due to the inadequacy of conventional furnace components.

It thus will be seen that the present method and apparatus for hardening metal parts achieves the various objects of the invention and is well adapted for the conditions of practical use. As numerous alternatives within the scope of the present invention, besides those variations and alternatives mentioned supra, will occur to those skilled in the art, it will be understood that the scope of this invention is limited only by the appended claims and equivalents thereof, both functional and structural.

What we claim is:

1. A method of hardening metal parts by heat treatment which comprises processing each metal part in a plurality of stages in a heat treatment box, said box having a central hollow chamber in which said metal part is disposed, an inner layer of continuous porous material which surrounds and defines said chamber of said box, said inner layer having porous openings which open to said chamber of said box, an outer layer of porous material external to and surrounding said inner layer, said outer layer being separated from said inner layer by a gas-tight barrier, said barrier conducting and permitting the passage and transfer of heat, and a gas-tight housing external to and surround said outer layer, said plurality of processing stages including:

(a) heating said metal part to a temperature above hardening temperature in a heating stage by circulating a heat releasing atmosphere through said inner and outer layers and circulating from said inner layer into and through said chamber of said box during said heating stage;

(b) treating said heated metal part by diffusion in a gaseous atmosphere releasing components for diffusion in a diffusion stage by causing said atmosphere releasing components for diffusion to enter said inner layer and pass from said inner layer into and through said chamber of said box during said diffusion stage, terminating the circulation of said heat releasing atmosphere through said inner layer during said diffusion stage, and maintaining the diffusion temperature in said box by circulating said heat releasing atmosphere through said outer layer during said diffusion stage;

(c) reducing the temperature of said metal part to a hardening temperature in a cooling stage, by interrupting the input of heat releasing atmosphere into said outer layer and causing a cooling atmosphere to enter said chamber of said box via said inner layer during said cooling stage; and (d) after reducing of the temperature to said hardening temperature, quenching said metal part in a quenching stage, the quenching being effected by a quenching medium.

2. The method of claim 1 in which the inner and outer layers comprise a ceramic material.

3. The method of claim 1 in which the inner and outer layers comprise zirconium dioxide.

4. The method of claim 1 in which the gas-tight barrier comprises silicon carbide with infiltrated silicon.

5. The method of claim 1 in which the heat releasing atmosphere circulated in stage (a) is a rich mixture of air and fuel gas, and combusting said heat releasing atmosphere in the pores of the material of which said inner and outer layers is composed so that no flames leave at least the inner layer.

6. The method of claim 5 comprising circulating under pressure the heat releasing atmosphere passing through the inner layer and into the chamber of the box thereby exposing the metal part to the impingement of jets of hot atmosphere leaving the pores of the inner layer, whereby a high heat transfer rate is produced.

7. The method of claim 5 in which the fuel gas is natural gas.

8. The method of claim 1 in which the heat releasing atmosphere circulated through the outer layer in stage (b) is a substantially stoichiometric mixture of air and fuel gas, and combusting said mixture in the pores of the outer layer.

9. The method of claim 1 comprising carburizing the metal part by the diffusion of components of the gaseous atmosphere which releases components for diffusion, in stage (b).

10. The method of claim 9 in which the gaseous diffusion atmosphere comprises carbon, carbon monoxide, carbon dioxide, hydrogen, water and nitrogen.

11. The method of claim 1 comprising carbonitriding the metal part by the diffusion of components of the gaseous atmosphere which releases components for diffusion, in stage (b).

12. The method of claim 11 in which the gaseous diffusion atmosphere is selected from the group consisting of carbon, carbon monoxide, carbon dioxide, hydrogen, water, nitrogen and ammonia.

13. The method of claim 1 in which the cooling atmosphere in stage (c) is a fluid selected from the group consisting of nitrogen and oil.

14. The method of claim 1 in which the quenching medium in stage (d) is selected from the group consisting of oil and supercooled liquid nitrogen.

15. The method of claim 1 comprising carrying the quenching stage (d) out in a separate cooling box having an inner chamber and a porous cooling box lining with continuous pore openings to said inner chamber of said separate cooling box, the quenching medium entering said inner chamber of said separate cooling box through said porous box lining.

16. The method of claim 1 comprising transporting the heat treatment box to successive box stations for stages (a), (b) and (c), the inner and outer layers being connected at each such station to the respective atmosphere for each stage, as required.

17. The method of claim 15 in which the quenching medium in stage (d) is a pressurized liquid.

18. The method of claim 17 in which the pore openings in said separate cooling box are generally arranged at right angles to the metal part, and discharging the pressurized liquid reaching the surface of the metal part at right angles to said surface.

19. The method of claim 17 comprising controlling the pressurized liquid flow to optimize the sequencing of the film evaporation, boiling, and convection phases of quenching for the particular quenching medium employed.

20. The method of claim 15 in which the quenching medium is a pressurized liquid, and passing said pressurized liquid through the pore openings of the porous lining of the cooling box to the metal part.

21. The method of claim 15 comprising transferring the metal part to the separate cooling box in an enclosure filled with a controlled atmosphere.

* * * * *